US008066275B2

(12) United States Patent
Persson

(10) Patent No.: US 8,066,275 B2
(45) Date of Patent: Nov. 29, 2011

(54) METHOD AND AN APPARATUS IN THE ADVANCEMENT OF PACKAGING BLANKS

(75) Inventor: Richard Persson, Häljarp (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 12/588,025

(22) Filed: Oct. 1, 2009

(65) Prior Publication Data

US 2010/0018159 A1 Jan. 28, 2010

Related U.S. Application Data

(62) Division of application No. 11/794,099, filed as application No. PCT/SE2005/001760 on Nov. 24, 2005, now abandoned.

(30) Foreign Application Priority Data

Dec. 27, 2004 (SE) ..... 0403192

(51) Int. Cl.
*B65H 1/08* (2006.01)

(52) U.S. Cl. ..... 271/129; 271/149; 271/128

(58) Field of Classification Search ..... 271/147, 271/149, 128, 129, 152, 153, 154, 155
See application file for complete search history.

(56) References Cited

U.S. PATENT DOCUMENTS

| | | | | |
|---|---|---|---|---|
| 2,554,579 | A * | 5/1951 | Lauffer | 271/150 |
| 3,881,718 | A | 5/1975 | Fernandez-Rana et al. | |
| 4,349,186 | A * | 9/1982 | Nakamura | 271/18 |
| 4,531,343 | A * | 7/1985 | Wood | 53/399 |
| 4,869,486 | A | 9/1989 | Scarpa et al. | |
| 5,297,785 | A * | 3/1994 | Ricciardi | 271/3.18 |
| 6,494,310 | B1 | 12/2002 | Furter | |
| 6,942,214 | B2 * | 9/2005 | Riccardi | 271/227 |

FOREIGN PATENT DOCUMENTS

| | | | |
|---|---|---|---|
| DE | 2 326 282 | A | 12/1974 |
| EP | 0 339 178 | A1 | 11/1989 |
| WO | WO 03/068644 | A1 | 8/2003 |

OTHER PUBLICATIONS

PCT/ISA/210 for PCT/SE2005/001760 dated Mar. 13, 2006.

* cited by examiner

*Primary Examiner* — Kaitlin Joerger
*Assistant Examiner* — Ernesto Suarez
(74) *Attorney, Agent, or Firm* — Buchanan Ingersoll & Rooney PC

(57) ABSTRACT

A method of advancing packaging blanks disposed standing upright in a magazine, one after the other, in a file or queue resting against the bottom of the magazine and disposed to be driven forwards through the magazine towards a stop at an outlet end for individual discharge comprises the file or queue of blanks being divided into two pressure zones, a first and forward pressure zone extending from the zone limit between the pressure zones up to the stop and displaying a first mutual pressure between neighboring blanks, as well as a rear second pressure zone displaying a second mutual pressure between neighboring blanks. The first mutual pressure is higher than the second mutual pressure. Another aspect of the disclosure pertains to an apparatus for carrying out advancement of the packaging blanks.

12 Claims, 1 Drawing Sheet

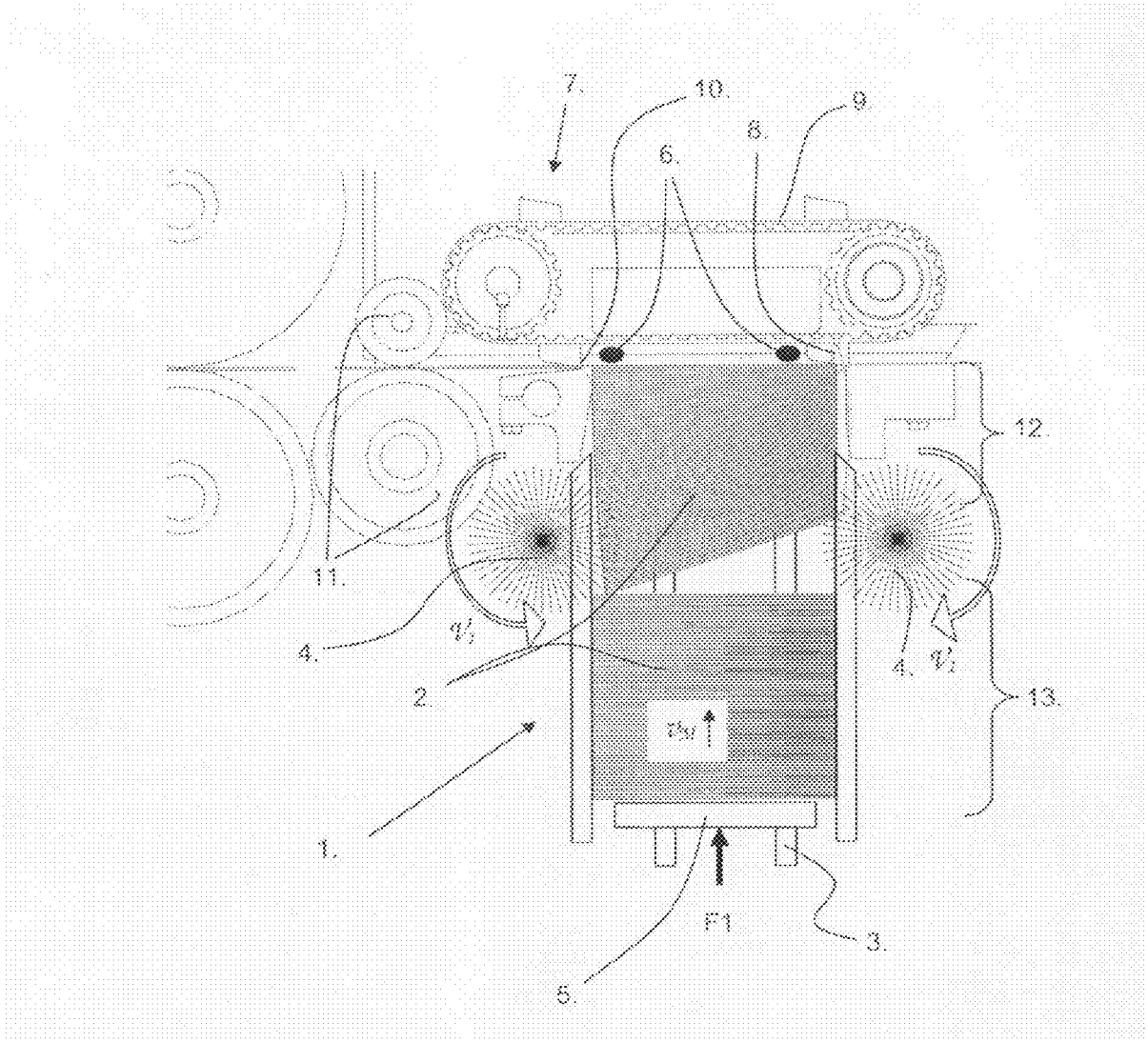
7.
10.
9.
8.
6.
12.
11.
4.
2.
4.
13.
1.
F1
3.
5.

METHOD AND AN APPARATUS IN THE ADVANCEMENT OF PACKAGING BLANKS

This application is a divisional of application Ser. No. 11/794,099 having a filing date of Jun. 25, 2007, which is a U.S. national stage application based on International Application No. PCT/SE2005/001760 filed on Nov. 24, 2005, which claims priority to Swedish Application No. 0403192-8 filed on Dec. 27, 2004, the entire content of each of which is incorporated herein by reference.

TECHNICAL FIELD

The present invention relates to a method and an apparatus in the advancement of packaging blanks disposed standing on end in a magazine, one after the other, and resting with one edge side against the bottom of the magazine.

BACKGROUND OF THE INVENTION

Apparatuses for automatically feeding flat-folded packaging blanks, for example cartons—with or without laminate—to a filling machine for raising and filling are previously known in the art. One such apparatus displays a magazine for packaging blanks and a discharge device for individual discharge of these blanks one by one out of the magazine.

The magazine usually displays a channel in which the blanks are disposed in queue or file for feeding through the magazine towards the discharge device. The channel displays a bottom which supports the blanks, side walls which laterally define the channel and guide the blanks, a front stop against which the first blank in the magazine is urged in order, in this position, to be grippable by the discharge device for discharge out of the magazine, as well as a carrier which, by applying a force from the rear against the last blank in the magazine thereby urges the first blank in the magazine against the stop.

In magazines of the above-mentioned type it is desirable to realise an even and uniform advancement of the blanks on their displacement through the magazine. This has hitherto been realised int. al. in that various measures have been implemented to minimise the friction which occurs between the bottom of the magazine and that part of the blanks resting against the bottom.

Another measure which has been proposed in the art is to provide control devices which regulate the force which, via carriers, abuts against the last blank in the magazine which, by a transfer of force via all of the other blanks in the magazine, finally urges the first blank in the magazine against the stop. This force is proposed to be greater when the magazine is full and smaller when the magazine contains a smaller quantity of blanks.

A further phenomenon to take into consideration when blanks are to be advanced through a magazine is the so-called spring back effect. This occurs when flat-folded, folded over/flattened blanks show a tendency to spring back to a state of equilibrium which, for example, may contribute to an advancement force which defies ready control.

SUMMARY

The object of the present invention is to realise a reliable advancement of packaging blanks through a magazine towards a stop at an outlet end of the magazine.

This object is attained by means of a method and an apparatus in the advancement of packaging blanks disposed standing upright in a magazine, one after the other, in a sequence with their respective lower edge regions resting against the bottom of the magazine and disposed to be driven forwards through the magazine towards a stop at an outlet end for the individual discharge of blanks, and which displays the characterising features as defined in the appended independent Claims.

In one embodiment, the method may include the step that the file or queue of blanks is divided into two pressure zones, a first and forward pressure zone extending from a zone limit between the pressure zones up towards the stop and displaying a first mutual pressure between neighbouring blanks, as well as a rear, second pressure zone displaying a second mutual pressure between neighbouring blanks, and that said first mutual pressure is higher than said second mutual pressure.

In other embodiments, devices displaying an elevated peripheral speed may be applied against the file of blanks from opposing directions locally at the zone limit for the formation of the relatively higher pressure in said forward pressure zone.

In yet further embodiments, the peripheral speed of the device in contact with a blank may be directed to drive the blank in a direction towards the outlet end of the magazine and exceed the advancement speed of blanks required at the pertinent discharge speed out of the magazine.

An apparatus according to the present invention may, in conjunction with the discharge end on either side of the file of blanks, display friction means disposed in contact with a number of the blanks disposed in the magazine, and the friction means in each respective contact may display a peripheral speed in a direction towards the outlet end which exceeds the advancement speed for the blanks required at the pertinent discharge speed. There will hereby be formed a zone between the friction means and the stop at a relatively elevated pressure compared with the general pressure prevailing in the remainder of the file of blanks, in which event the zone may be described as a dynamic pressure and adaptation zone for correct arrangement of the formermost blank against said stop.

Moreover, in yet a further embodiment, the friction means may display flexible projections which are disposed for frictional contact with the blanks.

The flexible projections in friction means may, in one embodiment, be supported by a rotary central shaft whose axis of rotation is at right angles in relation to the direction of advancement of the blanks and in relation to the bottom of the magazine.

In a further embodiment, the friction means may display bristles for contact with the blanks.

For instance, the friction means may display rotationally formed brushes with long or short elastic projections protruding from a rotary core, for example a shaft or cylinder or the like, or from a belt in a web or similar carrier.

Other constructional and detailed solutions than those listed here may also come into question in each specific case for reducing the present invention into practice.

BRIEF DESCRIPTION OF THE DRAWING

One embodiment of the present invention will be described in greater detail hereinbelow, with reference to the accompanying Drawing in which identical or similar parts have been given the same reference numeral. In the accompanying Drawing:

FIG. 1 schematically shows one example of a magazine provided with an apparatus exemplifying the present invention.

DETAILED DESCRIPTION

With reference to FIG. 1, this Figure shows one example of a magazine 1 with flat-folded packaging blanks 2 disposed standing on end in a queue or file with an edge portion against the bottom 3 of the magazine, one blank after the other, and in mutual contact by means their major surfaces.

The blanks 2 are driven forwards through the front end of the magazine 1 by means of two rotary brushes 4 which are disposed on opposing sides and which, by frictional engagement with some blanks 2, urge them forwards.

In order to supply the rotating brushes 4 with new blanks 2 from the rear section of the magazine 1, there is provided a pusher or carrier 5 which, from behind, applies a pushing force Fl against the last blank 2 in the magazine 1 in order to overcome any possible friction against the magazine 1 and ensure a continuous supply of blanks 2 to the brushes 4.

The advancement of the blanks 2 through the magazine 1 has for its purpose to urge the leading blank in the magazine 1 against a stop 6 and align it in a position from which it may subsequently be discharged out of the magazine 1 by means of a suitable discharge device 7. Further, the purpose is that a subsequent blank be placed forthwith in this position after the preceding blank has been discharged.

The discharge device 7 normally displays some form of carrier which, by engagement with the blank in position for discharge (the leading blank) and displace it out of the magazine 1. In the example illustrated in FIG. 1, this is shown by means of carriers 8 disposed at an endless chain 9 driven about two sprocket wheels. The carrier 8 is disposed to enter into engagement with an edge portion of the blank located in the discharge position (disposed against the stop 6) and displace it in the lateral direction through a discharge gap 10. When the blank has passed through the gap 10, it is grasped between two feeder wheels 11 which move the blank further, for example towards a packing machine for raising, filling and sealing.

There are many technical solutions obvious to the skilled reader of this specification of how the discharge out of a magazine 1 takes place, for which reason these will not be discussed in greater detail here. However, a feature common to most discharge devices is a wish that the blank 2 which is in turn to be discharged out of the magazine 1 be located in a predictable and predetermined position every time.

By disposing the rotating brushes 4 in the forward region of the magazine 1 and in register with one another on either side of the queue of file of blanks, with a limited number of blanks 2 between the brushes 4 and the stop 6, those blanks which are located ahead of the brushes 4—in the first pressure zone 12—will be acted on dynamically by an elevated pressure which is moreover self-adjustingly uniformly distributed between the sides of the blanks 2 and thereby in a position to even out any possible pressure variations from earlier positions in the magazine 1 and ensure that the first blank abuts correctly against the abutment points of the stop 6.

Too few blanks in the forward pressure zone 12 may over form and create instability, while too many blanks entails an inertia so that the dynamic orientation and reforming of the queue of file in the forward pressure zone 12 will not occur.

The selection of brush radius also sets a mechanical limit for how close to the stop 6 which the brushes 4 may be placed.

In one embodiment, a few tens of blanks 2 may be disposed ahead of the centre of the brushes 4 and the number of blanks in the rear zone 13 is of minor importance. In the embodiment according to FIG. 1, there are approx. 50 blanks in the forward pressure zone 12.

By the formation of the forward pressure zone 12, the pressure variations which occur often in prior art magazines between the abutment points of the front blank against the stop 6 can be handled and overcome. These pressure variations normally occur as a result of the fact that the blanks are not always entirely planar but may display thickness variations (in their turn because of, for example, folds or splices) across their extent. Since the blanks lie identically oriented after one another, a variation in thickness between the sides of a blank will be added by the number of blanks in the queue and the queue will deviate of and form an arc.

Compared with a traditional magazine of similar type with only advancement of the blanks 2 by means of a rear carrier 5, it is that force which the carrier 5 applies on the last blank in the magazine 1 is very low. The carrier 5 does not directly contribute in abutting and aligning that blank which is to be discharged in a position against the stop 6, but only to advance the blanks to a position where the brush 4 can reach them.

This also entails that a magazine according to one embodiment of the present invention may be replenished (in the rear region on the magazine) in that the carrier 5 is reversed and new blanks 2 are added, while the brushes 4 continue to ensure that the blanks 2 in the forward zone 12 maintain their mutual pressure and ensure advancement and positioning of the front blank in position for discharge. The time that is available for this replenishment depends, on the one hand, on the discharge speed from the magazine 1 and, on the other hand, on packaging thickness and the number of blanks 2 which the brush 4 simultaneously can be in contact with. In that the brushes 4 display a higher peripheral speed $v_1$ than the advancement speed $v_M$ of the blanks, the brushes 4 will, when the magazine 1 once again supplies new blanks 2, be capable of resetting and filling up the gap which has been formed in the magazine 1 during the replenishment.

Of some importance in this embodiment is that the pressure is uniformly distributed on both outer sides of the blank in order to achieve as good an abutment as possible between the first blank and the stop 6. In particular at the sides, on passage where the blank is to move out through a gap 10 and on the other side where the carrier is to enter into engagement with only this blank.

Advantageously, there may also be provided in the forward zone 12 a guide from above which presses down the blanks 2 that are not in contact with the bottom 3 of the magazine 1. This guide is advantageously a sliding surface which operates by shaking or vibration.

The side walls of the magazine 1 may be provided with apertures for the rotating brushes 4.

The side walls of the magazine 1 may also be designed with limited extent in the vertical direction so that the blanks are accessible, for example that the side walls are rod-shaped in which event a brush 4 may be divided into sections but driven about the same axis of rotation and act below and above the rod-shaped side wall, respectively.

In the illustrated embodiment, the brush has a diameter of 80 mm.

The brush 4 displays a contact zone against the file or queue of blanks which is capable of achieving the sought-for pressure increase. The reason for this is that if a pressure increase does not take place, the rearwardly positioned blanks in the file or queue will affect the guiding/orientation all the way up to the stop. In other words if the pressure from behind is as great as in the forward pressure zone 12 (that which the brushes 4 generate) no pressure increase will be created and then the first blank cannot be correctly oriented by being completely urged against the stop 6.

In the embodiment illustrated in FIG. 1, brushes 4 are used as examples of friction means for picking or riffling blanks 2 forward to the forward pressure zone 12 and realising the pressure increase. Other embodiments of friction means may include elastic projections, for example rubber fingers, impeller-like blades or the like which form a friction contact against some blank in the file or queue and which is driven by suitable drive means, such as a drive shaft, belts, linkage arms or the like which are employed.

The present invention should not be considered as restricted to that described above and shown on the Drawing, many modifications being conceivable without departing from the scope of the appended Claims.

The invention claimed is:

1. A method for advancement of packaging blanks comprising:

positioning packaging blanks upright in a magazine, one after another other, in a file or queue resting with one edge portion against a bottom of the magazine, the file or queue of blanks being divided into a first pressure zone and a second pressure zone, the first pressure zone extending in a forward direction from a zone limit between the first and second pressure zones up to a stop located at an outlet at a forward end of the magazine, and the second pressure zone positioned rearwardly of the first pressure zone;

applying a second pushing force to the blanks in the second pressure zone to display a second mutual pressure between neighboring blanks in the second pressure zone and push the blanks in the second pressure zone in the forward direction; and applying a first pushing force, independent of the second pushing force, to the blanks in the first pressure zone to display a first mutual pressure between neighboring blanks in the first pressure zone and push the blanks in the first pressure zone to move the entirety of each of the blanks in the forward direction, the first mutual pressure being higher than the second mutual pressure, and the first pushing force, independent of the second pushing force, applied to the blanks in the first pressure zone continuously pushing a leading blank at the forward end of the first pressure zone into contact with the stop.

2. The method as claimed in claim 1 further comprising individually discharging the packaging blanks from the magazine by laterally pushing the leading packaging blank relative to the upright positioning by pushing one side edge of the leading packaging blank so that an opposing side edge of the leading packaging blank is displaced through a discharge gap.

3. The method as claimed in claim 2, further comprising applying a peripheral speed locally against the file or queue of blanks at the zone limit from opposing directions so as to urge both side edges of the leading packaging blank to an abutment against the stop with a uniformly distributed pressure.

4. The method as claimed in claim 3, wherein the first pushing force in the first pressure zone is applied with the peripheral speed.

5. The method as claimed in claim 1, wherein the packaging blanks are flat-folded packaging blanks.

6. The method as claimed in claim 1, wherein the first pushing force applied to the blanks in the first pressure zone continuously pushes a leading blank at the forward end of the first pressure zone into contact with the stop with uniformly distributed pressure across the leading blank so that the leading blank is substantially planar when contacting the stop.

7. The method as claimed in claim 1, wherein the second pushing force applied to the blanks in the second pressure zone is applied with a second pushing device, and the first pushing force applied to the blanks in the first pressure zone is applied with a first pushing device in the first pressure zone to advance the blanks in the first pressure zone in the forward direction to an area downstream of the first pushing device and before the stop.

8. An apparatus for advancement of packaging blanks comprising:

a magazine for holding the packaging blanks, one after the other, in a file or queue, the magazine comprising an outlet end at which is located a stop;

a discharge device positioned adjacent the outlet end of the magazine which discharges the packaging blanks from the magazine;

a pair of rotatably mounted shafts positioned on respective sides of the magazine, and a plurality of flexible projections extending outwardly from each of the shafts to frictionally contact edges of a plurality of the packaging blanks and apply a first pushing force to the packaging blanks urging the packaging blanks towards the forward end of the magazine;

a pusher for applying a second pushing force to a last one of the packaging blanks of the file or queue of packaging blanks to urge the packaging blanks in a direction towards the rotatably mounted shafts;

the flexible projections of the shafts displaying a peripheral speed in a direction towards the outlet end of the magazine which acts on the blanks in the magazine to advance a forwardmost one of the blanks downstream of the shafts and against the stop;

the shafts being positioned relative to the magazine so that during rotation of the shafts with the flexible projections acting on the blanks, the file or queue of blanks is divided into a first pressure zone and a second pressure zone, the first pressure zone extending in a forward direction from a zone limit between the first and second pressure zones up to the stop, and the second pressure zone positioned rearwardly of the first pressure zone; and the rotating shafts with the flexible projections acting on the blanks applying the first pushing force to the blanks in the first pressure zone to display a first mutual pressure between neighboring blanks in the first pressure zone and push the blanks in the first pressure zone to move the entirety of each of the blanks in the forward direction, and the second pushing force being applied to the blanks in the second pressure zone to display a second mutual pressure between neighboring blanks in the second pressure zone and push the blanks in the second pressure zone in the forward direction only to advance the blanks to a position where they are influenced by the first pushing force in the first pressure zone, the first mutual pressure being higher than the second mutual pressure.

9. The apparatus as claimed in claim 8, further comprising an endless chain and two feeder wheels, wherein the endless chain is disposed at a discharge carrier positioned at the stop and engageable with the leading packaging blank, the two feeder wheels being configured to grasp the leading packaging blank after the leading packaging blank is displaced through a discharge gap.

10. The apparatus as claimed in claim 8, wherein the magazine holds the packaging blanks in an upright position, and the discharge device engages the leading packaging blank and pushes the leading packaging blank laterally relative to the upright position by pushing one side edge of the leading packaging blank so that an opposing side edge of the leading packaging blank is displaced through a discharge gap.

11. The apparatus as claimed in claim 8, wherein the first pushing force generated by the flexible projections of the shafts, which advances a forwardmost one of the blanks downstream of the shafts to move the forwardmost one of the blanks against the stop, is independent of the second pushing force from the pusher.

12. The apparatus as claimed in claim 8, wherein the first pushing force generated by the flexible projections of the shafts pushes a forwardmost one of the blanks against the stop with uniformly distributed pressure across the leading blank so that the leading blank is substantially planar when contacting the stop.

* * * * *